United States Patent [19]

Sindermann

[11] 3,964,526

[45] June 22, 1976

[54] METHOD AND APPARATUS FOR CLEANING ROTARY FILLING MACHINES

[75] Inventor: Siegmar Sindermann, Pelkum, Germany

[73] Assignee: Holstein & Kappert Maschinenfabrik Phonix GmbH, Dortmund, Germany

[22] Filed: Feb. 19, 1974

[21] Appl. No.: 443,883

[30] Foreign Application Priority Data

Feb. 20, 1973 Germany ..... 2308190

[52] U.S. Cl. ..... 141/1 R; 134/22 R; 134/152; 141/90; 222/148

[51] Int. Cl.[2] ..... B65B 3/04; B67D 1/08

[58] Field of Search ..... 134/22 R, 22 C, 33, 134/152, 166 R, 167 R, 168 R, 169 R, 171; 137/240; 141/1, 39, 85, 89–92; 222/148; 239/119

[56] References Cited

UNITED STATES PATENTS 3,513,024 5/1970 Calliton ..... 141/90 X

*Primary Examiner*—Richard E. Aegerter
*Assistant Examiner*—Frederick R. Schmidt
*Attorney, Agent, or Firm*—Toren, McGeady and Stanger

[57] ABSTRACT

In cleaning and sterilizing rotary backpressure filling machines which include filling elements and a pressure actuated conveyor operatively associated therewith, the conveyor is adapted to support rinsing vessels used in cleaning the filling elements. More particularly, the cleaning operation of is effected by inserting, fastening and detaching a rinsing vessel upon the filling machine with a rinsing operation occurring while the rinsing vessel is fastened to the machine. The rinsing vessel includes axially movable sleeve which cooperates with radially movable clamping members, preferably in the form of spherical balls, to attach the rinsing vessel to an air and/or gas fill pipe of the filling machine, with pressure being introduced into the rinsing vessel to actuate valve means enabling flow of cleansing fluid through the machine. The rinsing vessel is operatively supported upon the conveyor and the cycle of machine operation generally includes attachment of the rinsing vessel, performance of the cleansing operation and subsequent detachment of the rinsing vessel.

7 Claims, 3 Drawing Figures

METHOD AND APPARATUS FOR CLEANING ROTARY FILLING MACHINES

BACKGROUND OF THE INVENTION

The present invention relates generally to a method and apparatus for cleaning and sterilizing rotary backpressure filling machines. The filling machines comprise filling elements and pressure actuated conveyor means which operate to support the vessels during the machine operation. More particularly, invention relates to a method and apparatus for effecting a cleansing operation by attachment of a rinsing vessel to the filling machine by operation of the pressure actuated conveyor means, with a cleansing operation occurring during the time that the rinsing vessel is in the attached condition and with the rinsing vessel being automatically detached by operation of the filling machine after cleaning.

In apparatus of the type to which the present invention relates, the filling of beverages requires absolute cleanliness in the portions of the filling machine within which the liquid beverage is carried. For this reason, the liquid carrying parts of a rotary bottle filling machine must be cleaned and sterilized at regular intervals. In such an operation, all the parts of the filling element of the machine which are arranged exteriorly of the liquid tank must also be exposed to the cleaning fluid.

In accordance with a known art method for cleaning such filling machines, the filler tank of the machine is connected through the liquid feed pipe to a filler feed pump by means of which the tank may be filled completely with cleaning fluid. During a subsequent slow rotation of the machine, all filling and relief valves are open so that fluid flow may be established as a result of the overpressure of the pump of the machine through the fluid outlet duct. Additionally, partial fluid flow is established through the relief valve of the machine. The cleaning fluid is collected in a ring conduit and is fed once again to the feed pump. However, in this known measure unsatisfactory results are attained because this approach is incapable of achieving the desired level of microbiological cleanliness required in the filling machine. This is particularly true since the relatively narrow relief ducts, as well as the parts of the air pipe leading to the exterior of the machine together with the centering device of the machine cannot be sufficiently exposed to the cleaning fluid due to pressure drop at the level of the fluid outlet pipe connection.

It has therefore been proposed to clamp a rinsing vessel to the machine which encloses the return air pipe between the vessel centering bell arranged at its bottom position and the press fit of the filling element. Such a rinsing vessel bears upon the centering bell holder and, to this end, the bell is removed from the holder and cleaned by hand outside the filling machine.

Since such a rinsing vessel consists of a closed housing upon which there is guided a supporting ring, the supporting ring rests on a centering lug of the centering bell holder and presses the rinsing vessel housing under a spring force against the press fit of the filling element. In this known design, the rinsing pressure acting within the vessel is absorbed by the pressure spring. In order to permit easy handling of the rinsing device, only a relatively low surface pressure may be effected. Consequently, the counteracting rinsing pressure is also limited. This results in an additional disadvantage in that the relatively narrow ducts provided for antechamber air and relief of the vessel interior of the rinsing fluid are not sufficiently reached because of the low rinsing pressure. Furthermore, it becomes impossible to circulate the rinsing fluid with a cleaning fluid at the inner surfaces of the centering bell which is disassembled in this case. This known approach will not permit operation beyond such automatic cleaning as it also requires automatic closure of the filling element after a relatively short preparation time, since all the rinsing vessels must be inserted by hand thereby requiring considerable time particularly in view of present day heavy duty machines which frequently involve up to 164 filling stations.

SUMMARY OF THE INVENTION

The present invention is aimed at alleviating problems and disadvantages involved in methods of the type previously described by providing a method and apparatus wherein all processes occur substantially automatically and wherein a maximum degree of safety is ensured for the cleaning of the filling machine with cleaning of all fluid-carrying parts being achieved. The problems are solved according to the present invention in that after a rinsing vessel has been introduced, it is raised toward the centering element of the machine and it is placed under pressure in this state so that it is fastened on the filling element with the fastening being effected automatically and with continued pressure increase, for example, when pressure equalization has been achieved between the interior of the rinsing vessel and the filling machine tank, initiating operation of the rinsing process by opening the fluid valve. Rinsing is limited to spaces and openings below the valve seat, and after lowering of pressure actuated conveyor means of the machine and with resulting closing of the fluid valve, while maintaining rinsing pressure, and with continued rotation of the filling machine, the process is started once again by applying the pressure actuated conveyor means against the rinsing vessel with pressure being applied thereto.

The measures of the present invention fully meet the requirements discussed above and give rise to an advantage in that the rinsing operation is not interrupted during the forced lowering of the lifting or pressure actuated conveyor means at the level of the outflow star and the subsequent lifting behind the inflow star. Rather, it becomes possible to direct the rinsing accurately to the lower regions of the filling element below the fluid valve and the return gas pipe. After the passage through the outflow and inflow regions of the machine, the main rinsing process is started again by lifting the pressure actuated conveyor means with resulting opening of the fluid valve after pressure equalization occurs.

In a further aspect of the present invention, the rinsing vessel is locked by pressing against parts of the filling element and subsequent admission to its interior of rinsing pressure and is removed from the filling machine by relieving the interior pressure and subsequently lowering the pressure actuated conveyor means.

In an additional aspect of the invention, the use of a rinsing vessel held by pressure admission on parts of the filling element is involved.

A device suitable for carrying out the method according to the invention for an arrangement for cleaning and sterilizing rotary backpressure filling machines for cleaning filling elements with a rinsing vessel is characterized by the fact that the rinsing vessel includes a fastening mechanism which is actuated during axial movement of a part of the vessel.

A particularly expedient design of a device for carrying out the method of the invention is characterized by the fact that the rinsing vessel consists of housing parts which are telescopically movable against spring pressure, with one of the housing parts being designed as a sliding sleeve which is operatively associated with clamping means which are actuated by movement thereof in a direction extending radially of the axis of the housing. In accordance with the invention, the fastening mechanism is adapted to engage the air and/or filling pipe of the filling machine.

In the construction of the rinsing vessel, a cylindrical inner member is provided and a sleeve is arranged to be slidably movable relative thereto, with an additional part being provided which is movable relative to the sliding sleeve. Radially acting clamping means are also provided which engage the filler pipe of the filling machine. The radially acting clamping means have their radial range of motion limited by a recess formed in the sliding sleeve which determines the outermost position of the clamping means. The innermost position of the clamping means is limited by a conically tapered surface formed on the sliding sleeve.

It has been found expedient to form the sliding sleeve in a divided configuration and to arrange in engagement therewith a supporting ring which is displaceable relative to the sleeve in a radial direction.

In the operation of the invention, the rinsing vessels are placed on the feeder element of the machine directly before the start of the cleaning operation of the filling machine, and the rinsing vessel is brought to a desired distance from the dividing screw. As soon as a rinsing vessel is engaged by a standing platform of the pressure actuated conveyor means, the platform rises in a known manner toward the filling element of the machine and presses a sealing element against the filling element thereby entraining the centering element. Immediately thereafter, backpressure is produced by opening the antechamber air duct of the machine so that the axis movement of an inner vessel part is commenced and so that the fastening mechanism is thus moved toward the fill pipe of the machine. With continued admission of pressure to the interior, the pressure between the rinsing vessel and the filling machine tank becomes equalized after a short period of time. Thus, the fluid valve opens automatically and the rinsing fluid begins to circulate, with the vacuum valve being open. During this process, all fluid carrying parts are satisfactorily reached by the cleaning fluid. With continued rotation of the filling machine, a position is finally reached where the lifting elements are forceably moved downwardly. At this moment, an outside relief of the rinsing vessel sets in, so that the inner part provided with the clamping means is moved downwardly by the internally acting pressure applied to it and by a compression spring thereby closing the fluid valve. At this moment, the rinsing is directed accurately through the return gas pipe to the parts of the filling element arranged therebelow.

DESCRIPTION OF THE DRAWINGS

The present invention will be better understood by reference to the following detailed description of the preferred embodiments thereof taken in connection with the accompanying drawings wherein.

DETAILED DESCRIPTION OF THE PREFERRED EMBODIMENTS

Figure 1:
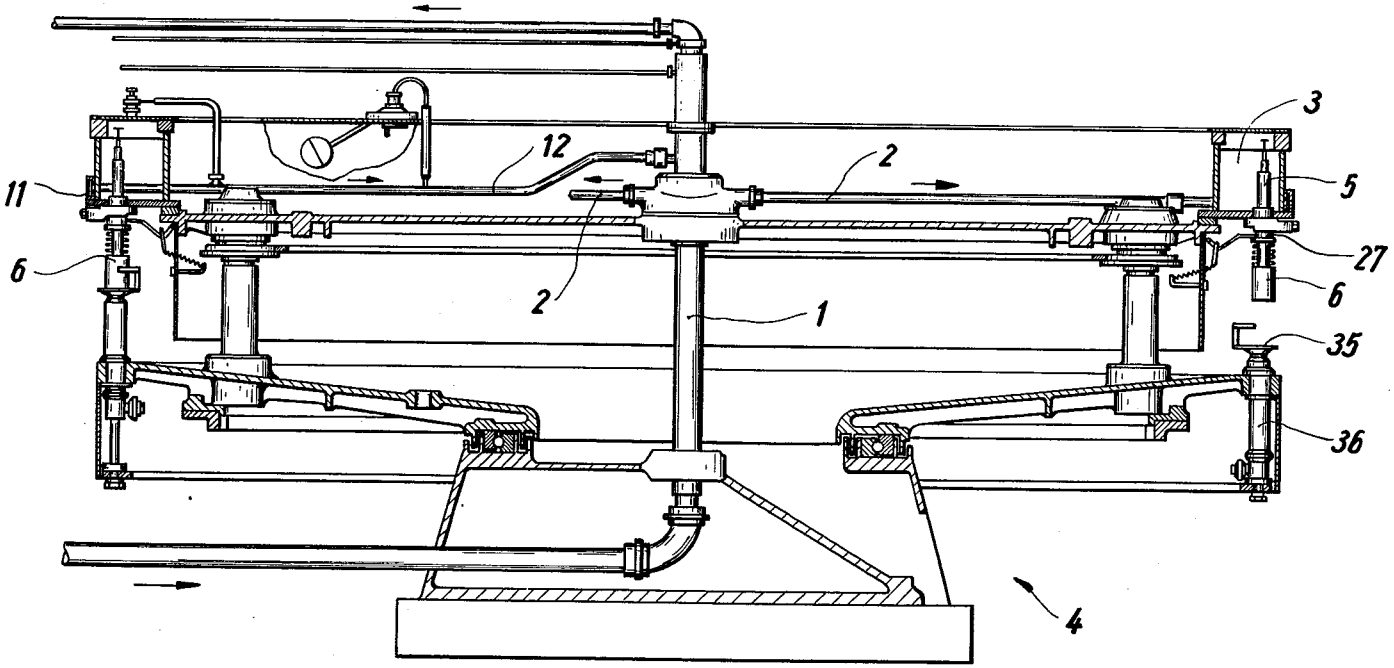
FIG. 1 is a schematic view showing parts of a filling machine to be cleaned and indicating the flow pattern of fluid therethrough.

Referring now to the drawings, wherein like reference numerals refer to similar parts throughout various figures thereof, the flow pattern involved in the cleaning of a filling machine is shown particularly in the schematic flow chart of FIG. 1. Cleaning fluid is forced by a pump (not shown) through a line 1 and through distributor lines 2 into an annular tank 3 of a rotary filling machine 4 with the fluid flowing therethrough to filling elements 5 and into a rinsing vessel 6 arranged therebeneath.

Figure 2:
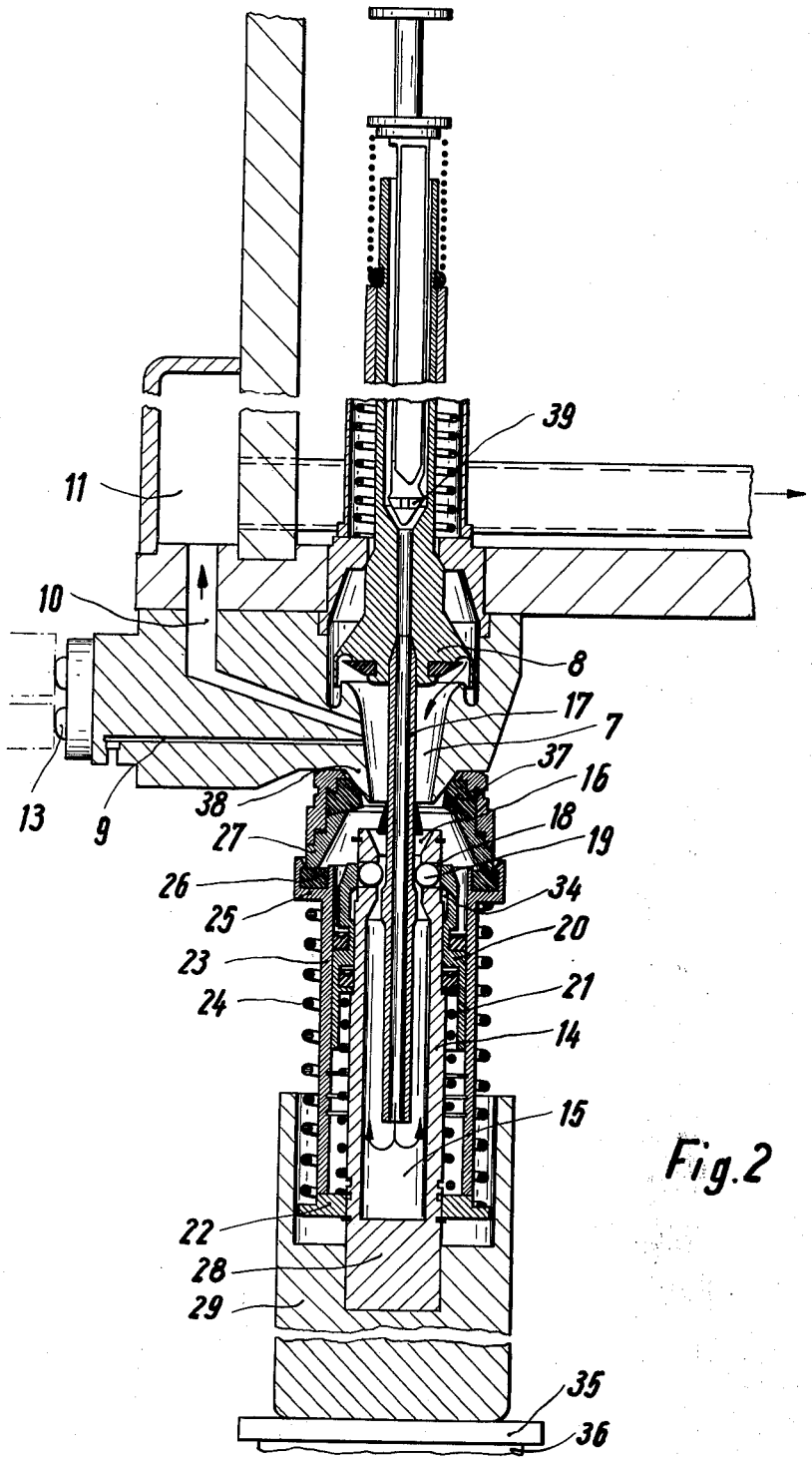
FIG. 2 is a sectional elevation of a rinsing vessel structured in accordance with the present invention shown in its attached position upon the filling machine.

A bypass passage 9 is arranged to lead from a fluid outlet pipe connection 7 located above the rinsing vessel 6, as best seen in FIG. 2, into the atmosphere and an evacuation duct 10 extends in fluid communication to a vacuum chamber 11. A bypass valve 13 is provided, and the cleaning fluid flows through the duct 9 into the atmosphere, with the cleaning and bypass valves open, and through the evacuation duct 10 into the vacuum chamber 11 from which it may escape through a discharge pipe 12, seen in FIG. 1, in the direction of the vacuum pump where it is returned shortly thereafter through a switch valve into the cleaning vessel. The bypass valve 13 is kept open only long enough to permit the duct 9 and the valve elements to have been sufficiently cleaned.

The rinsing vessel provided in accordance with the present invention and as represented in FIG. 2, consists of a cylindrical inner member 14 which includes a bore 15 which is conically widened at its upper end 16 to facilitate introduction of an air or gas pipe 17. Several radial openings 18 of the inner member 14 are provided within which there are located clamping means 19, preferably consisting of a plurality of spherical balls. A sliding sleeve 20 is arranged about the inner member 14 for relative motion in the axial direction against the action of a spring 21. The spring 21 bears against a disk 22 which is adjustably arranged on the inner member 14, with the arrangement being dependent upon the length and design of the selected gas or fill pipe 17. An outer member 23 slides upon the sliding sleeve 20 against the action of a spring 24, which likewise bears upon the disk 22. A packing 26 is provided on the upper edge 25 of the outer member 23 with the effective packing range of the packing 26 corresponding with the lower end face of a conically widened centering bell 27.

The parts of the rinsing vessel described above are connected by an extended shaft 28 of the inner member 14 with a centering element 29 which corresponds in diameter with the lower section of a normally used bottle and which can be replaced as desired by elements having a different diameter.

Figure 3:
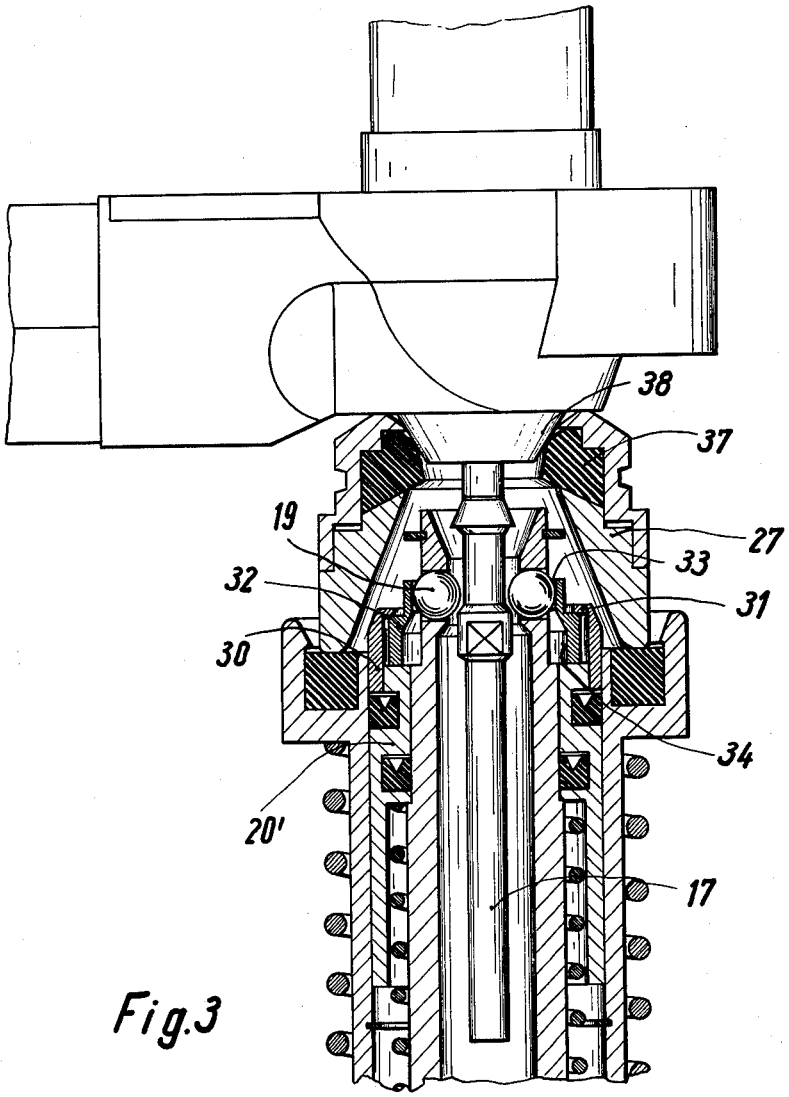
FIG. 3 is a partial sectional elevation of a second embodiment of the rinsing vessel.

The embodiment of the present invention as depicted in FIG. 3 involves a rinsing vessel which is substantially similar to the vessel shown in FIG. 2 except that a divided sliding sleeve 20' is provided. Additional differences between these embodiments involve the provision in the embodiment of FIG. 3 of an additional ring 30 having inwardly protruding webs 31 and a pressure ring 32 with the axial movement of the pressure ring 32 being limited by the protruding webs 31. The pressure ring 32 is guided with radial play within the ring 30 in order that there may be received within the rinsing vessel a fill or gas pipe 17 which is in a canted or tilted position. Thus, this configuration enables attachment to such a tilted pipe 17 independent of the centric arrangement of the rinsing vessel. In both of the embodiments of the invention, the sliding sleeves 20 and 20' and the pressure ring 32 are shown in their bottommost positions in FIGS. 2 and 3. Thus, these elements are in their pressing position. In this position, the outer surfaces of the balls 19 are limited in their movement by the inner shell and the rinsing vessel is blocked. As soon as either the sliding sleeve 20 or the sleeve 20', or the pressure ring 32, reach their uppermost position, a recess 34 will coincide with the radial range of motion of the balls 19 which will thus be enabled to roll radially outwardly to ensure a free passage for the introduction or removal of the fill or gas pipe 17.

Rinsing vessels are placed shortly prior to the start of the rinsing process on a feeder element of the filling machine 4 and they are brought along a divided screw mechanism (not shown) through a necessary distance and along a curved inlet track to the standing trays 35 of the pressure actuated conveyor means 36. After passing through the inflow region of the machine, the pressure actuated means 36 rise automatically from their bottommost position and move the rinsing vessel resting thereupon toward the centering bell 27 which moves with continued movement of the pressure actuated means with its packing ring 37 toward a press fit 38 with the filling element 5. The pressure actuated elements 36 remain in this position until they have reached the outflow region of the filling machine 4.

As soon as a tight seal is achieved, the rinsing vessel is placed under pressure by opening the antechamber air valve 39. A slight pressure will be found sufficient to move either the sliding sleeve 20 or the sleeve 20' and the pressure ring 32, into their bottommost positions so that the clamping means 19 bearing upon the inner surface 33 will be moved a slight distance toward the pipe 17. In this manner the rinsing vessel will be held upon the filling element 5. The fluid valve is not limited in its axial movement. As soon as the pressure is equalized between the interior of the rinsing vessel and the filling machine tank, the fluid valve 8 will automatically open.

The tank of the filling machine is filled almost to its rim so that cleaning fluid may flow through the outlet pipe connection 7 and the return gas or fill pipe 17 into the rinsing vessel. In the meantime, the vacuum valve has also opened and in this way fluid flows through the evacuation duct 10, the vacuum chamber 11 and the outflow pipe 12 into the cleaning vessel.

When the pressure actuated element 36 has reached the outflow region of the filling machine, it will be moved downwardly and the rinsing vessel will remain in tight connection with the filling element without requiring support. At this time, the compression spring 24 will begin to act to urge the inner member 14 and the sliding sleeve 20, or the sliding sleeve 20' and the pressure ring 32, into their bottommost position so that the freely suspended fluid valve 8 will be closed. Cleaning of the fill or return gas pipe 17 will, at this time, be initiated along with the superposed ducts and the parts below the fluid valve 8. When the pressure actuated element 36 has again reached the inflow region of the machine or has passed beyond it, the centering element 29 will bear against the support tray 35. The inner member 14 with the return gas pipe 17 firmly enclosed will be thus moved back again into its uppermost position and the opening of the fluid valve 8 will be initiated. The cleaning process now takes place once again in the above-described manner and the end of the cleaning process will be started by closing of the antechamber air valve in association with the lowering of the fluid valve 8. During the subsequent relief, pressure in the interior of the rinsing vessel will drop so that sliding sleeve 20, the sliding sleeve 20', the ring 30 and the pressure ring 32 will move back into their starting positions under the action of spring 21, thus increasing the range of motion of the clamping means 19 radially around the recess 34. At the level of the outflow region, the pressure actuated means 36 will move downwardly and the clamping means 19 will return into their outermost position, thus permitting with ease the removal of the rinsing vessel.

In a case where a rinsing vessel is to be used on a fill pipe filling machine, the fill pipes are provided with a shoulder to receive and support the clamping means.

While specific embodiments of the invention have been shown and described in detail to illustrate the application of the inventive principles, it will be understood that the invention may be embodied otherwise without departing from such principles.

What is claimed:

1. A method of cleaning and sterilizing a rotary backpressure filling machine by introducing, securing and detaching a rinsing vessel to effect rinsing, said filling machine including at least one filling element, a tank in communication with said filling element and containing a cleaning fluid, fluid valve means in said filling element to control flow from said tank, and pressure actuated conveyor means associated therewith and adapted to support said rinsing vessel, said method comprising the steps of during rotation of said filling machine introducing said rinsing vessel to said conveyor means, centering and raising said rinsing vessel upon said pressure actuated conveyor means toward said filling element and fastening said rinsing vessel to said filling element, increasing pressure in said rinsing vessel to achieve equalization of pressure within said rinsing vessel and within the tank of said filling machine, causing the fluid valve means of said filling machine to open as a result of said pressure equalization thereby commencing the flow of cleaning fluid from said tank into said rinsing vessel, lowering said pressure actuated conveyor means and thereby closing said fluid valve means while maintaining said rinsing vessel fastened to said filling element, and recommencing said rinsing by continued rotation of said filling machines by raising said pressure actuated conveyor means against said rinsing vessel and reopening said fluid valve means.

2. A method according to claim 1, wherein said rinsing vessel is fastened to said filling element by pressing said rinsing vessel against parts of said filling element with subsequent admission of backpressure to its interior, and removing said rinsing vessel from said filling element of said filling machine by relieving said backpressure from its interior and subsequent lowering of said rinsing vessel on said pressure actuated conveyor means.

3. Apparatus for cleaning and sterilizing a rotary back pressure filling machine comprising a tank containing a cleaning fluid, an upwardly extending filling element in communication with said tank for receiving cleaning fluid therefrom, said filling element including an axially extending cleaning fluid pipe connection for flowing the cleaning fluid from said filling element and a fill pipe extending downwardly through and from said pipe connection, an air valve associated with said fill pipe for controlling the flow of air through said fill pipe, a rinsing vessel adapted to be releasably connected to said filling element for receiving cleaning fluid from said pipe connection, seal means on said rinsing vessel for effecting a sealing engagement with said filling element, said air valve arranged to open automatically for supplying air under pressure into said rinsing vessel when said seal means on said rinsing vessel provides sealing engagement with said filling element, said rinsing vessel including an upwardly extending cylindrically shaped member laterally enclosing said fill pipe and fastening means mounted on said cylindrically shaped member for releasably securing said rinsing vessel to said filling element by securing said cylindrically shaped member to said fill pipe, said fastening means including movable means laterally enclosing and slidably displaceable on said cylindrically shaped member in the axial direction of said pipe connection, said fastening means releasably securing said rinsing vessel on said filling element by axial displacement of said movable means on said cylindrically shaped member in response to a slight pressure afforded by air under pressure admitted to said rinsing vessel through said fill pipe when said air valve is opened, spring means laterally surrounding said cylindrically shaped member and in contact with said movable means, said movable means being telescopically movable against the spring force of said spring means over said fill pipe for releasably securing said rinsing vessel to said filling element, said fastening means including clamping members disposed about said fill pipe and movably displaceable in a direction approximately perpendicularly of the axial direction of said pipe connection, and said movable means including a sliding sleeve disposed about and in engagement with said clamping members for effecting the displacement of said clamping members for releasably securing said rinsing vessel onto said filling element.

4. Apparatus, according to claim 3, wherein said fill pipe extends in the axial direction of said pipe connection, and said clamping members are arranged for releasably securing said rinsing vessel to said fill pipe.

5. Apparatus, according to claim 3, wherein said cylindrically shaped member is open at its top and closed at its bottom, said movable means comprises said sliding sleeve laterally enclosing said cylindrically shaped member, and an outer member laterally enclosing said sliding sleeve and being movable relative thereto, said clamping members being located within said sliding sleeve and being displaceable in the clamping direction by the inner surface of said sliding sleeve, said sliding sleeve including recesses in the inner surface thereof for limiting the displacement of said clamping members outwardly from said cylindrically shaped member, and said sliding sleeve having a conically tapered portion on its inner surface adjacent said recesses for limiting the displacement of said clamping members inwardly toward said cylindrical by shaped member.

6. Apparatus, according to claim 5, wherein said sliding sleeve comprises a divided sleeve, a ring encircling one end of said sleeve, and a pressure ring located within said ring with the inner surface of said pressure ring disposed in contact with said clamping members and containing said recesses and conically tapered surface for limiting the movement of said clamping members relative to said filling element.

7. Apparatus, according to claim 3, wherein said clamping members comprise a plurality of spherical balls displaceable in the radial direction relative to the axial direction of said pipe connection.

* * * * *